US005301799A

United States Patent [19]

Gurba, Jr.

[11] Patent Number: 5,301,799

[45] Date of Patent: Apr. 12, 1994

[54] PORTABLE PAINT BRUSH HOLDER

[76] Inventor: Ronald S. Gurba, Jr., Box 13214, Monroe, La. 71213

[21] Appl. No.: 42,795

[22] Filed: Apr. 6, 1993

[51] Int. Cl.[5] ..... B65D 85/20

[52] U.S. Cl. ..... 206/1.7; 206/362

[58] Field of Search ..... 206/1.7-1.9, 206/15.2, 15.3, 361, 362, 362.1, 362.2, 362.3, 362.4, 443

[56] References Cited

U.S. PATENT DOCUMENTS

| | | | |
|---|---|---|---|
| 1,803,194 | 4/1931 | Kennedy | 206/209.1 |
| 3,132,653 | 5/1964 | Gazdik | 206/15.2 |
| 3,884,635 | 5/1975 | Sloan | 206/209 |
| 4,162,005 | 7/1979 | Linger | 206/362 |
| 4,533,044 | 8/1985 | Ban | 206/362 |
| 4,978,003 | 12/1990 | Foster | 206/361 |

FOREIGN PATENT DOCUMENTS

| | | | |
|---|---|---|---|
| 0080215 | 6/1983 | European Pat. Off. | 206/362 |

*Primary Examiner*—Jimmy G. Foster
*Attorney, Agent, or Firm*—Alfred F. Hoyte, Jr.

[57] ABSTRACT

A portable paint brush holder having a hollow cylindrical main body with two open ends. A rubber stopper is inserted into one end to act as a base for the device. A plurality of variably sized apertures are formed in the rubber stopper to provide support for a plurality of brushes of different sizes. A flexible cap having square outer dimensions is adapted to fit snugly over the other end. The square outer dimensions of the cap serve to prevent rolling of the device when it is placed on an inclined surface.

6 Claims, 1 Drawing Sheet

PORTABLE PAINT BRUSH HOLDER

The present invention relates to a device for holding and transporting a plurality of relatively small paint brushes, particularly the kind used by artists.

DESCRIPTION OF THE PRIOR ART

The specific problem of storing and transporting paint brushes is recognized and well known in the art. Accordingly various devices have been developed for this purpose.

U.S. Pat. No. 3,302,798 shows an artist's brush holder which is designed to be attached to the edge of a pallette. Although the device can hold brushes in an upright position it is not portable. U.S. Pat. No. 3,776,371 another non-portable artist's brush holder.

U.S. Pat. No. 4,134,525 issued to Respoli discloses a traveling case for artists brushes. The brushes can be maintained in a seperable, readily accesible upright position. The Respoli device suffers from several drawbacks. First, the structure is relatively massive compared to the size of the brushes. Therefore, although it is itself portable it cannot be easily contained in a briefcase or the like. Second, the device has a hinged door. It is well known that such a relatively small and inexpensive moving part is subject to failure after repeated use. Finally, because the structure is relatively complex it will also be relatively expensive to manufacture. The cost will of course be passed on to the consumer.

SUMMARY OF THE INVENTION

In accordance with the aforementioned drawbacks of the prior art it is an object of the present invention to provide a portable device for storing and transporting paint brushes, particularly artists brushes.

It is another object of the invention to provide a portable device for storing and transporting paint brushes which is lightweight and compact.

It is another object of the invention to provide a portable brush storage device which stores the brushes in an upright position.

It is another object of the invention to provide a portable brush storage device which is inexpensive to manufacture.

It is another object of the invention to provide a portable brush storage device which is not subject to mechanical failure.

These and other objects of the present invention are accomplished by providing a device having a hollow cylindrical main body with two open ends. A rubber stopper is inserted into one end to act as a base for the device. A plurality of variably sized apertures are formed in the rubber stopper to provide support for a plurality of brushes of different sizes. A flexible cap having square outer dimensions is adapted to fit snugly over the other end. The square outer dimensions of the cap serve to prevent rolling of the device when it is placed on an inclined surface.

DETAILED DESCRIPTION

Figure 1:
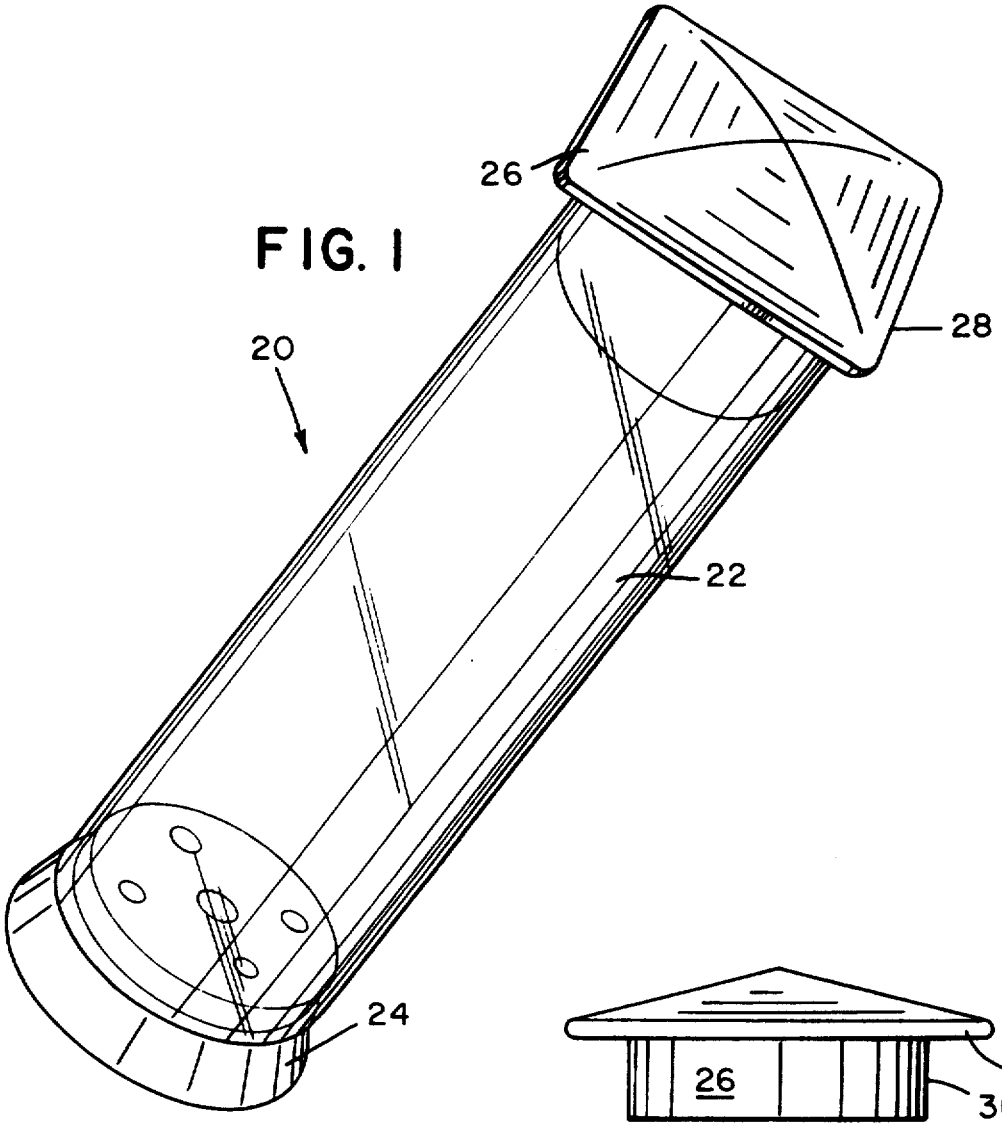
FIG. 1 is a perspective view of the present invention.
Figure 2:
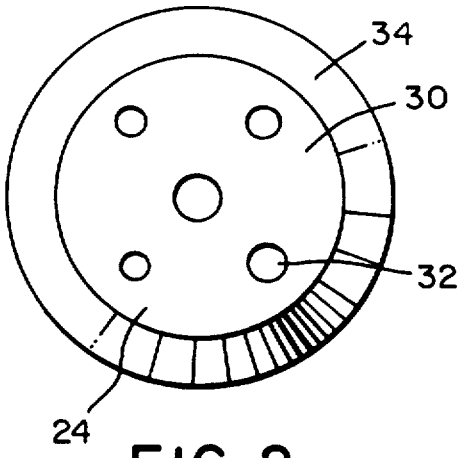
FIG. 2 is a top view of the rubber stopper which is used as the base for the present invention.

Referring now to FIG. 1 a perspective view of the present invention 20 is shown. When completely assembled, the portable paint brush holder 20 comprises a cylindrical main body 22 having open ends. One end of the main body 22 is fitted with a stopper or base 24 which serves to support the main body 22 in an upright position. Base 24 is also provided with a plurality of apertures 32 as is shown in FIG. 2. These apertures 32 are of different sizes and extend all the way through the base 24. Although only five apertures 32 are shown in FIG. 2 it can be readily appreciated that as many apertures 32 as desired can be formed in base 24 with the only limitation being that adequate spacing between the brushes (not shown) must be maintained.

It is well known in the art that in order to maintain the brushes in top condition they should be maintained in the upright position, especially when drying. Accordingly apertures 32 are formed of various sizes and of sufficient depth to securely hold brushes in the upright position. It can be appreciated that since the apertures 32 extend through the entire base 24 the same aperture 32 can hold brushes having slightly different outer diameters. In the preferred embodiment base 24 is made a relatively hard rubber compound as is commonly available for rubber stoppers. Of course, any slightly deformable material having good surface friction can be used. Also in the preferred embodiment main body 22 is made of transparent semi-rigid plastic.

It should be noted at this point that apertures 32 hold the brushes in place firmly enough so that regardless of the position of the base 24 the brushes do not come into contact with each other. Thus if the main body 22 is in the horizontal position as would be typically the case the bristles of the brushes would not be damaged due to contact.

Figure 3A:
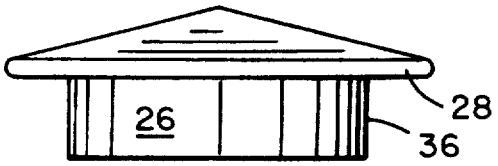
FIGS. 3*a* and 3*b* show side and top views of the cap used to provide a sealing cover for the present invention.
Figure 3B:
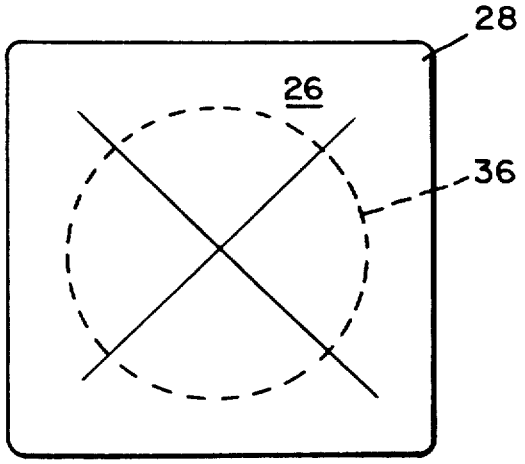

Referring now to FIG. 3, FIG. 3(*a*) shows a side view of the cap 26. Cap 26 has a rectangular top portion 28 and an integrally formed downwardly extending substantially cylindrical bottom portion 36. Top portion 28 serves two purposes. First, it serves as gripping edge so that the cap 26 can be easily removed. Top portion 28 also provides an anti-roll feature. Referring to FIG. 3(*b*), top portion 28 is square so that if the main body 22 is placed horizontally on an inclined surface it will not roll. In the preferred embodiment cap 26 is made of latex rubber so that it can fit snugly around the end of main body 22 so as to provide a tight seal therewith.

I claim:

1. A portable paint brush holder adapted to hold a plurality of brushes firmly in a seperable, readily accesible position comprising;

a hollow cylindrical main body having open first and second ends;

a base adapted to fit snugly into said first end and capable of supporting said main body in an upright position, said base having a plurality of apertures formed therein, said apertures adapted to hold brushes securely in an upright position;

a covering for said second end, said covering having a top portion and a bottom portion, said top portion having a rectangular outer diameter and said bottom being substantially cylindrical, the covering adapted to fit over the second end in sealing engagement therewith.

2. The apparatus as claimed in claim 1 where said apertures in the base adapted to accomodate brushes of various sizes.

3. The apparatus as claimed in claim 1 where said covering is made of a readily deformable material.

4. The apparatus as claimed in claim 1 where said cylindrical container is transparent.

5. The apparatus as claimed in claim 1 where said covering prevents the paint brush holder from rolling when placed on an inclined surface.

6. The apparatus as claimed in claim 1 where said brushes are maintained in separate, non-contacting positions regardless of the orientation of the base.

* * * * *